US006299162B1

(12) United States Patent
Ogasawara

(10) Patent No.: US 6,299,162 B1
(45) Date of Patent: Oct. 9, 2001

(54) PAPER FEEDING MECHANISM FOR PRINTER

(75) Inventor: Masashi Ogasawara, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/611,637

(22) Filed: Jul. 7, 2000

(30) Foreign Application Priority Data

Jul. 9, 1999 (JP) ..... 11-195757

(51) Int. Cl.[7] ..... B65H 5/02

(52) U.S. Cl. ..... 271/272; 271/274; 271/275; 271/314

(58) Field of Search ..... 271/272, 273, 271/274, 275, 314; 198/780; 193/35 R

(56) References Cited

U.S. PATENT DOCUMENTS 3,770,103 * 11/1973 Ball et al. ..... 198/780 X
4,014,539 * 3/1977 Goodwin ..... 198/780 X
4,053,039 * 10/1977 Shuttleworth ..... 198/780 X
4,611,802 * 9/1986 Pedersen ..... 271/274
5,269,509 * 12/1993 Cromar et al. ..... 271/272
5,653,439 * 8/1997 Rider et al. ..... 271/274
6,089,567 * 7/2000 Yatsuhashi et al. ..... 271/314

OTHER PUBLICATIONS

Unexamined Appl. Publ. No. 10–202972, Aug. 4, 1998, Japan.
Unexamined Utility Model Appl. Publ. No. 6–47245, Jun. 28, 1994, Japan.

* cited by examiner

*Primary Examiner*—David H. Bollinger
(74) *Attorney, Agent, or Firm*—Brinks Hofer Gilson & Lione

(57) ABSTRACT

Disclosed is a paper feeding mechanism making it possible to reliably prevent deflection of the paper feeding roller and perform a stable paper feeding free from feeding deviation even when the paper feeding roller is formed as an elongated member. There is arranged a paper feeding roller and a plurality of press contact rollers held in press contact with the paper feeding roller, and there is arranged on the opposite side of the press contact rollers with respect to the paper feeding roller a support block which is held in contact with the peripheral surface of the paper feeding roller to support the paper feeding roller.

3 Claims, 7 Drawing Sheets

PAPER FEEDING MECHANISM FOR PRINTER

BACKGROUND OF THE INVENTION

1. Field of the Invention

The present invention relates to a paper feeding mechanism for a printer and, in particular, to a paper feeding mechanism for a printer capable of appropriately feeding a paper having a large width dimension.

2. Description of the Related Art

As the output apparatuses of computers, word processors, facsimile apparatuses, etc., various printers, such as thermal transfer printers, page printers or the like are generally used.

And, in these conventional printers, there is provided a paper supplying mechanism for supplying one by one a plurality of recording paper sheets stacked together and accommodated by a paper supplying roller, and there is provided a paper feeding mechanism for conveying the recording paper sheets fed from the paper supplying mechanism to a predetermined recording position. Or, there is provided a paper supplying mechanism for continuously supplying a roll of recording paper by a paper supplying roller, and there is provided a paper feeding mechanism for conveying recording paper fed from the paper supplying mechanism to a predetermined recording position.

In such a conventional paper feeding mechanism, there is provided a paper feeding roller which is rotatable by a paper feeding motor, and there are provided a plurality of press contact rollers which are in press contact with the paper feeding roller. And, the recording paper supplied from the paper supplying mechanism is conveyed while being held by the paper feeding roller and the press contact rollers.

Recently, however, a printer is in demand which is capable of performing recording on a recording paper not smaller than A3. In such a printer it is necessary for the length of the paper feeding roller to be made long in accordance with the width of the recording paper.

As a result, the paper feeding roller is deflected due to the weight of the paper feeding roller itself and the press contact force of the press contact rollers, making it impossible to perform rotation with a fixed rotation axis. When the paper feeding roller is thus deflected, a deviation is generated in the conveyance of the recording paper even when the paper feeding roller is accurately rotated, making it impossible to perform accurate conveyance. Further, since the paper feeding roller is rather long, it is difficult to accurately produce a well-balanced paper feeding roller which does not easily involve runout during the rotation thereof. To prevent deflection of the paper feeding roller and reduce runout thereof, the diameter of the paper feeding roller might be increased. However, when the diameter of the paper feeding roller is increased, the production cost of the paper feeding roller increases. Further, the so-called bottom margin (blank area that does not allow printing) cannot be reduced, resulting in a deterioration in the paper feeding performance.

SUMMARY OF THE INVENTION

The present invention has been made in view of the above problems. It is an object of the present invention to provide a paper feeding mechanism for a printer capable of reliably preventing the deflection of the paper feeding roller and runout thereof, thereby making it possible to perform stable paper feeding free from feeding deviation.

To achieve the above object, there is provided, according to the present invention, a paper feeding mechanism for a printer, comprising a paper feeding roller rotatable by a paper feeding motor, and one or more press contact rollers held in press contact with the paper feeding roller and arranged in the axial direction of the paper feeding roller, recording paper supplied being fed while being held between the paper feeding roller and the press contact roller, wherein there is arranged on the opposite side of the press contact roller with respect to the paper feeding roller at least one support block which is in contact at two positions with the peripheral surface of the paper feeding roller.

According to the present invention, a support block is arranged on the opposite side of the press contact roller with respect to the paper feeding roller, and the support block is brought into contact with the peripheral surface of the paper feeding roller at two positions, and the paper feeding roller is rotated, with the paper feeding roller being supported by the support roller, whereby recording paper supplied from the paper supplying mechanism is conveyed while being held between the paper feeding roller and the press contact roller, conveying the paper to a predetermined recording position. In accordance with the present invention, the support block is held in contact with the peripheral surface of the paper feeding roller at two positions to support the paper feeding roller, so that even when the paper feeding roller is elongated, it is possible to reliably prevent deflection or runout of the paper feeding roller. Furthermore, since only two positions of the peripheral surface of the paper feeding roller is supported by a cutout portion of the support block, it is possible to greatly reduce the friction when the paper feeding roller rotates, making it possible to rotate the paper feeding roller with a small driving force.

Further, according to the present invention, there is provided a paper feeding mechanism for a printer, wherein a support roller rolling while in contact with the peripheral surface of the paper feeding roller is rotatably supported by the support block.

According to the present invention, the support roller of the support block is held in rolling contact with the paper feeding roller to support the paper feeding roller, so that even when the paper feeding roller is elongated, it is possible to reliably prevent deflection or runout of the paper feeding roller. Further, since the paper feeding roller is supported by the support roller in rolling contact with the paper feeding roller, the support roller does not constitute a rotation resistor when the paper feeding roller is rotated, and it is possible to rotate with paper feeding roller with a small driving force and rotate the paper feeding roller at high speed.

According to the present invention, there is provided a paper feeding mechanism for a printer, comprising a paper feeding roller rotatable by a paper feeding motor, and one or more press contact rollers held in press contact with the paper feeding roller and arranged in the axial direction of the paper feeding roller, recording paper supplied being fed while being held between the paper feeding roller and the press contact rollers, wherein there is arranged on the opposite side of the press contact rollers with respect to the paper feeding roller a support block by which a support roller rolling while in contact with the peripheral surface of the paper feeding roller is rotatably supported.

According to the present invention, a support block is arranged on the opposite side of the arrangement position of the press contact roller with respect to the paper feeding roller, and the paper feeding roller is rotated, with the paper feeding roller being supported by the support roller while holding the support roller of the support block in rolling contact with the peripheral surface of the paper feeding roller, whereby recording paper supplied is conveyed while being held between the paper feeding roller and the press contact roller to convey it to a predetermined recording position. In accordance with the present invention, the support roller of the support block is held in rolling contact with the paper feeding roller to support the paper feeding roller, so that even when the paper feeding roller is elongated, it is possible to reliably prevent deflection or runout of the paper feeding roller. Further, since the paper feeding roller is supported by the support roller in rolling contact with the paper feeding roller, the support roller does not constitute a rotation resistor when the paper feeding roller is rotated, and it is possible to rotate the paper feeding roller with a small driving force, and rotate the paper feeding roller at high speed.

According to the present invention, when a plurality of support blocks are arranged along the axial direction of the paper feeding roller, it is possible to prevent deflection or runout at a plurality of positions in the axial direction of the paper feeding roller, making it possible to support the paper feeding roller in a more stable manner.

DESCRIPTION OF THE PREFERRED EMBODIMENTS

Embodiments of the present invention will now be described with reference to FIGS. 1 through 7.

Figure 1:
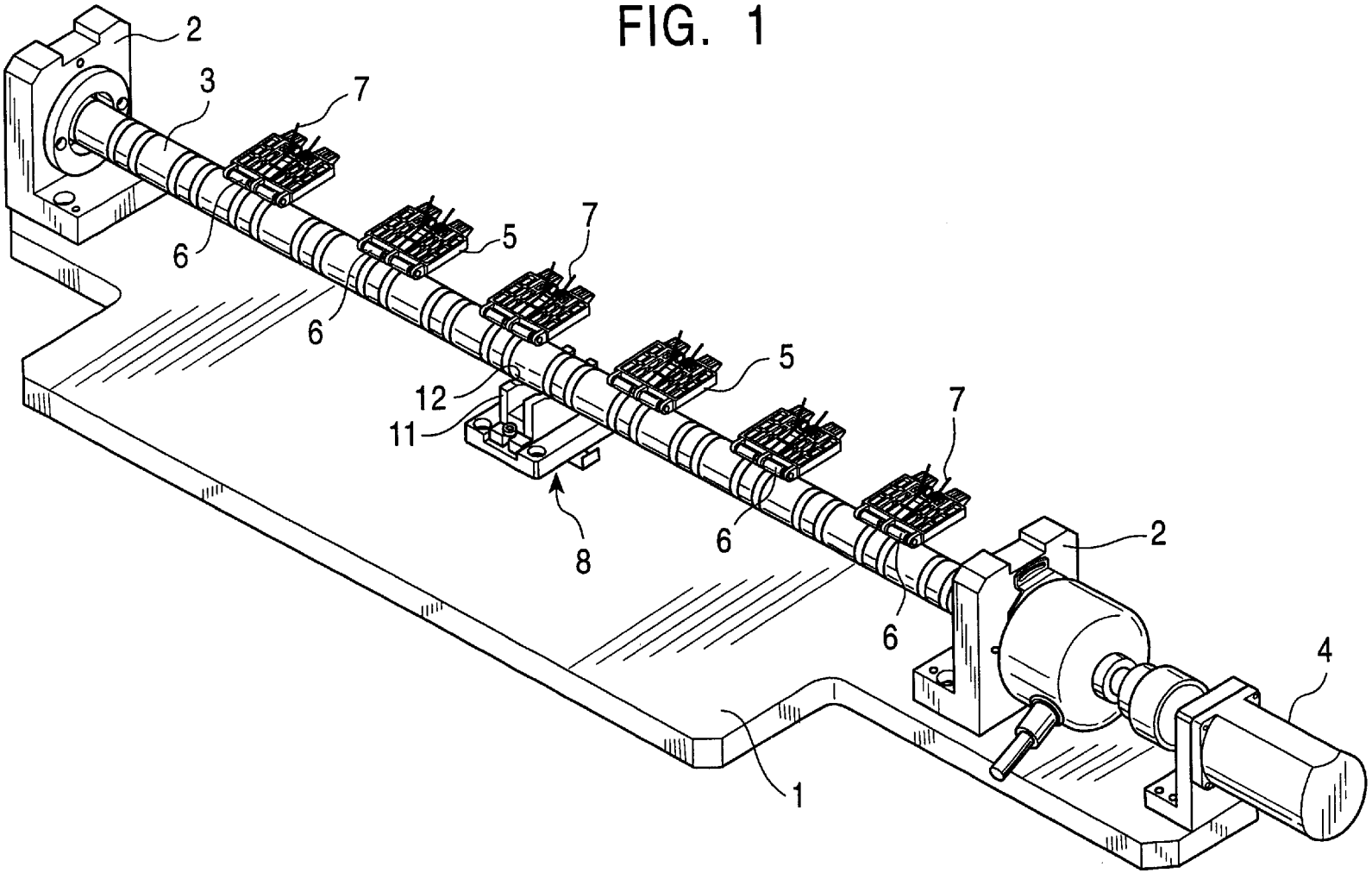
FIG. 1 is a schematic perspective view showing a paper feeding mechanism for a printer according to an embodiment of the present invention.
Figure 2:
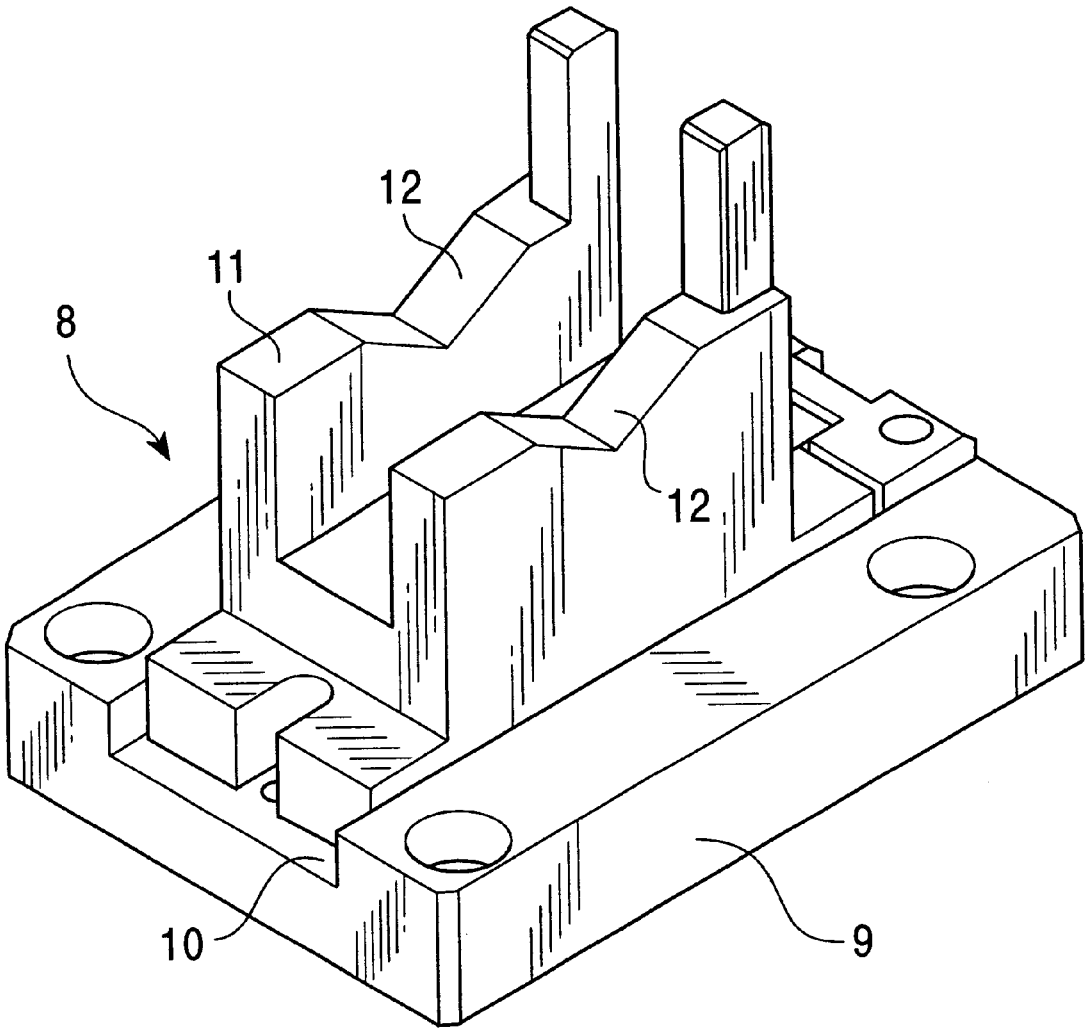
FIG. 2 is a perspective view showing the support block of the paper feeding mechanism shown in FIG. 1.
Figure 3:
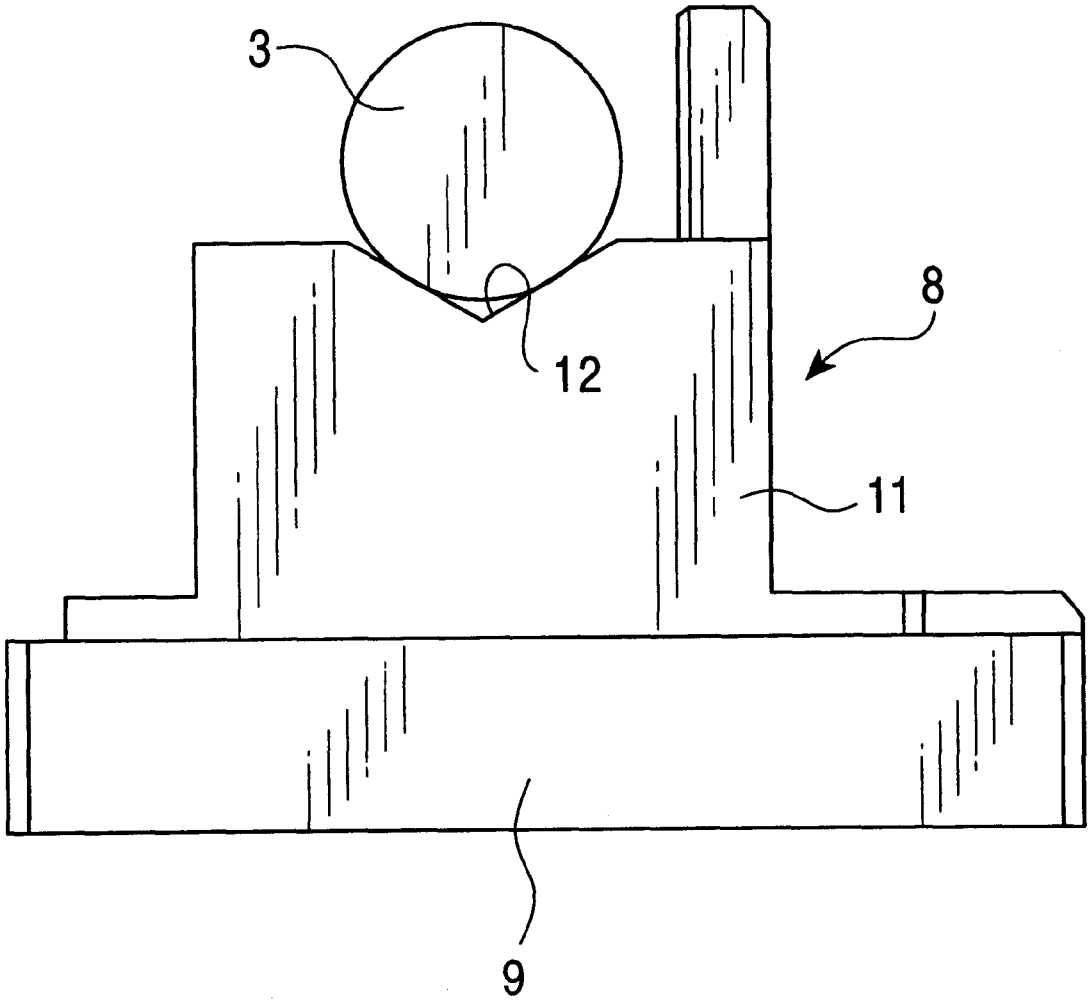
FIG. 3 is a side view of the support block shown in FIG. 1.
Figure 4:
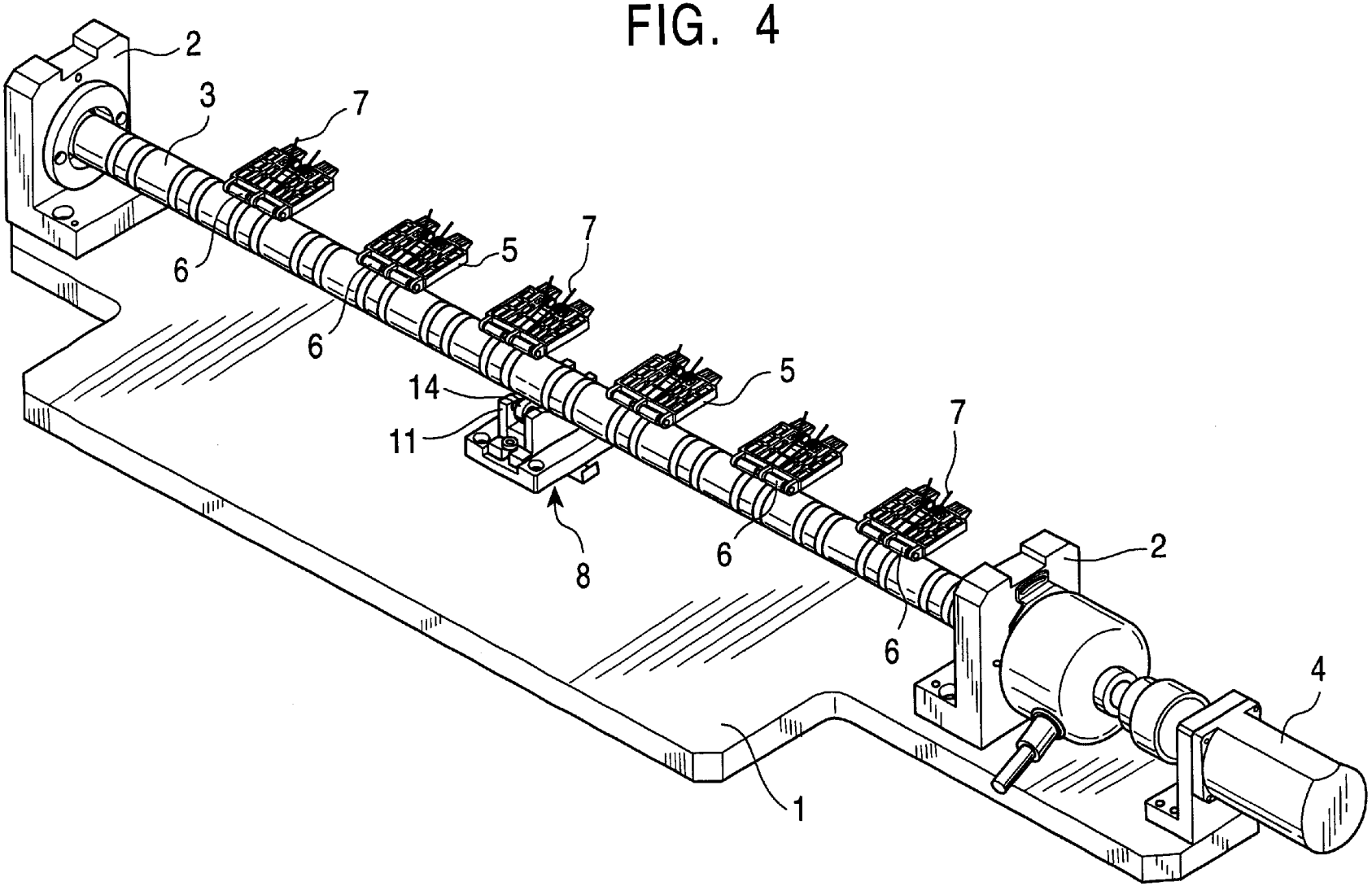
FIG. 4 is a schematic perspective view showing a paper feeding mechanism for a printer according to another embodiment of the present invention.
Figure 5:
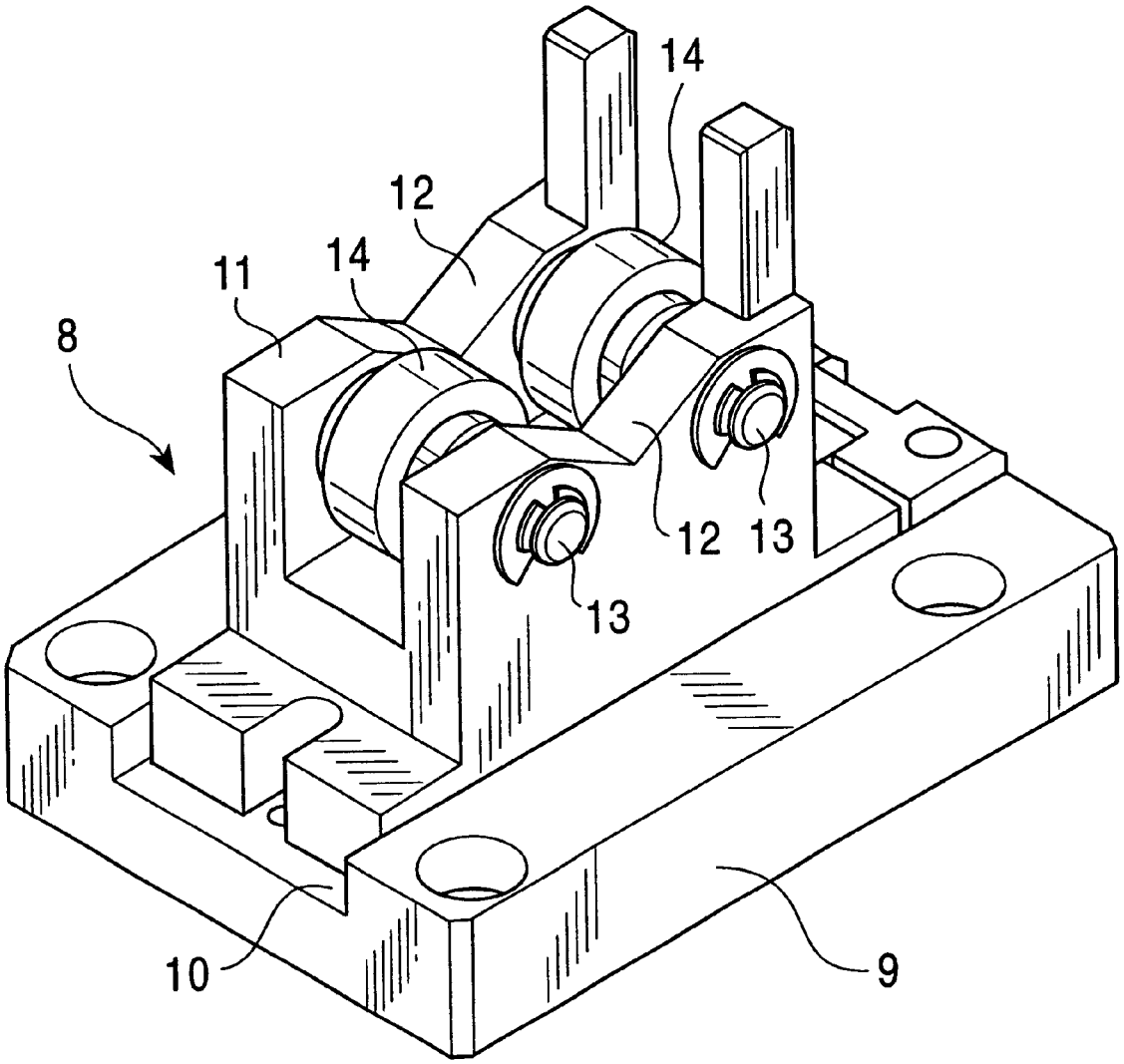
FIG. 5 is a perspective view showing the support block of the paper feeding mechanism shown in FIG. 4.
Figure 6:
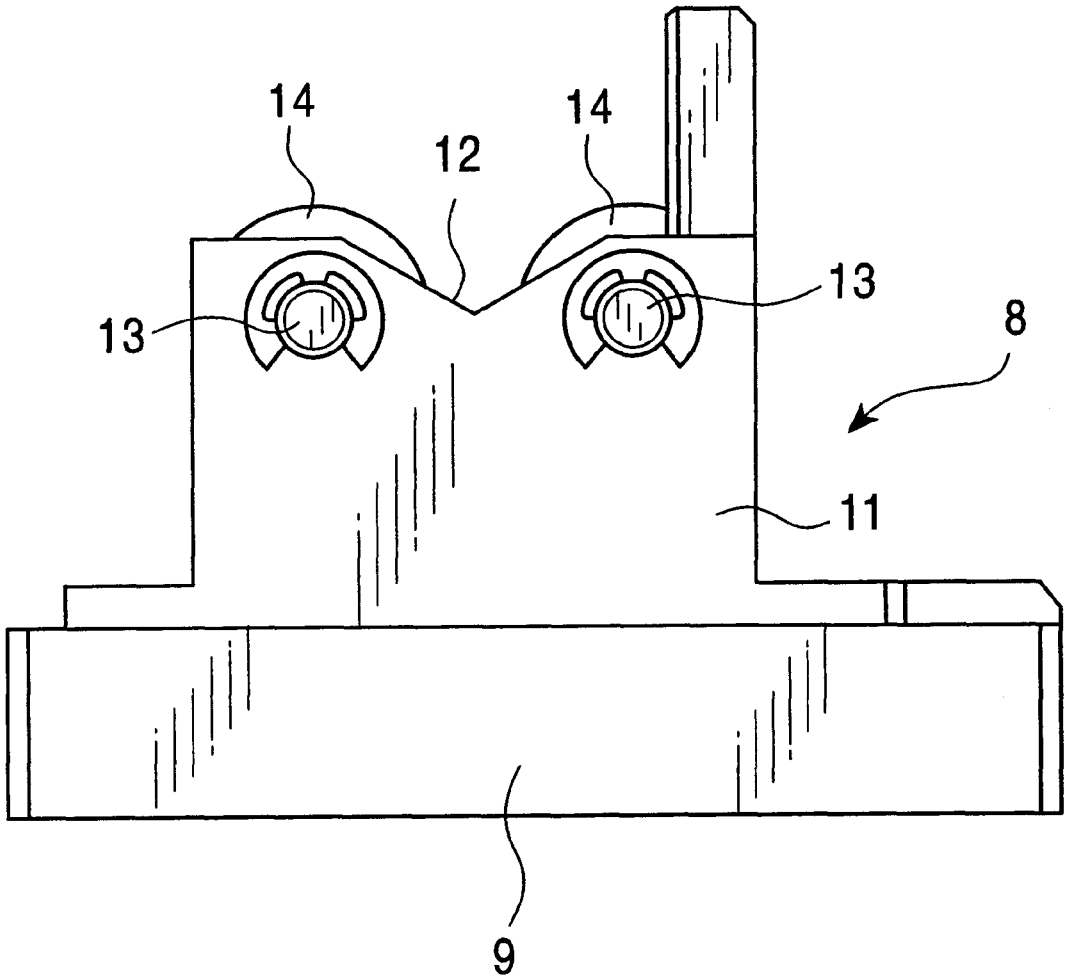
FIG. 6 is a side view of the support block shown in FIG. 5.
Figure 7:
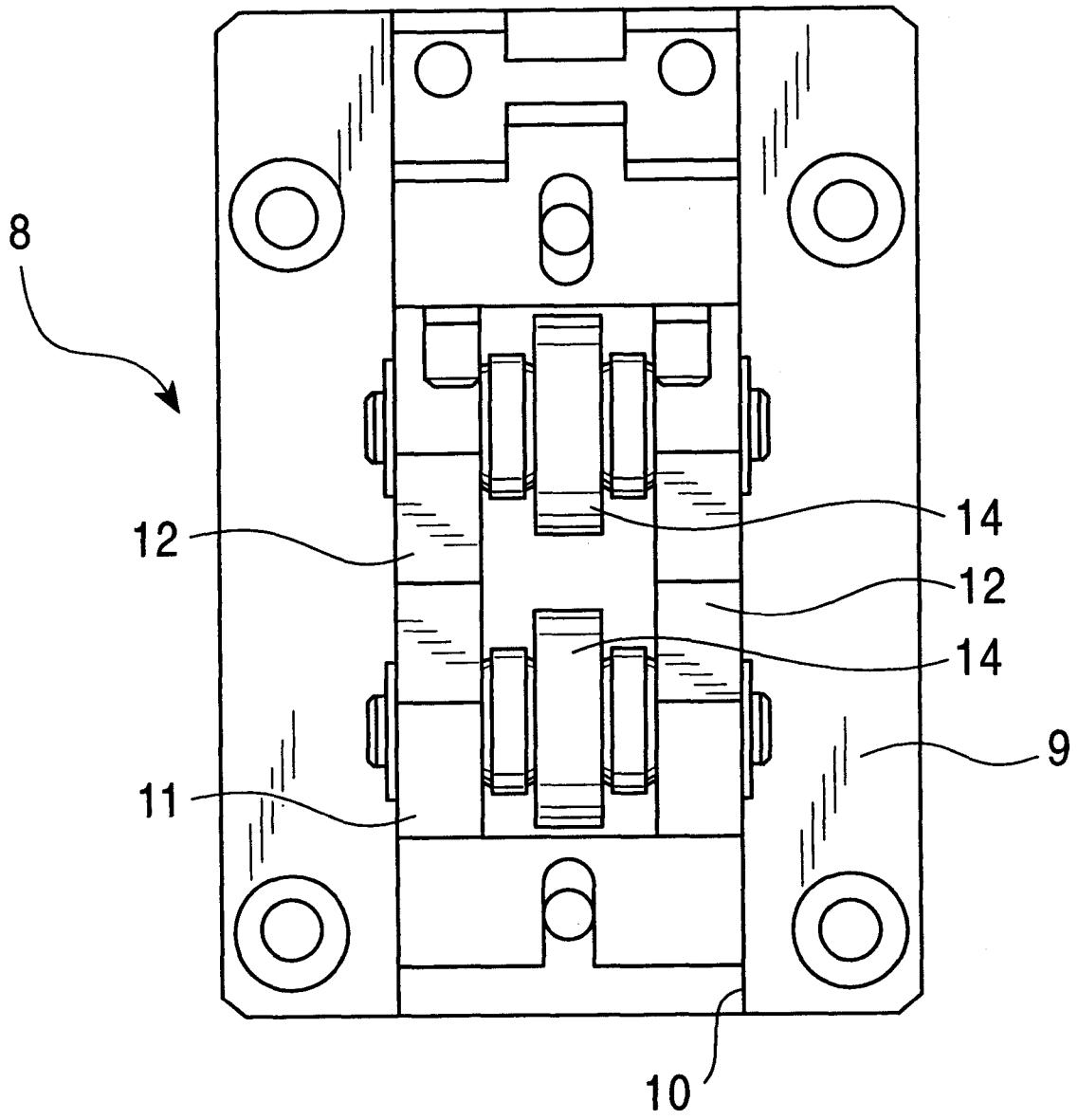
FIG. 7 is a plan view of the support block shown in FIG. 5.

FIGS. 1 through 3 show an embodiment of the paper feeding mechanism for a printer of the present invention. A pair of bearing plates 2 are raised at the ends of a printer frame 1. An elongated paper feeding roller 3 is rotatably supported by the bearing plates 2. A paper feeding motor 4 is mounted to one end of the paper feeding roller 3. By driving the paper feeding motor 4, the paper feeding roller 3 can be rotated.

Further, over the paper feeding roller 3, a plurality of press contact plates 5 are arranged at predetermined intervals along the axial direction of the paper feeding roller 3. Each of the press contact plates 5 is vertically swingable using the base sides as the fulcrum. At the forward ends of the press contact plates 5, press contact rollers 6 are rotatably supported so as to be rotatable around an axis parallel with the rotation axis of the paper feeding roller 3. The press contact plates 5 are constantly biased toward the paper feeding roller 3 by the biasing force of biasing springs 7, whereby the press contact rollers 6 are constantly in press contact with the peripheral surface of the paper feeding roller 3. While in this embodiment a plurality of press contact rollers are arranged at predetermined intervals in the axial direction of the paper feeding roller 3, it is also possible to use a single press contact roller having the same length as the paper feeding roller 3 and hold this single press contact roller in press contact with the paper feeding roller 3.

Further, in this embodiment, a support block 8 is arranged below the paper feeding roller 3 and on the opposite side of the arrangement positions of the press contact rollers 6. A plurality of support blocks 8 may also be arranged, for example, at predetermined intervals in the axial direction of the paper feeding roller 3. The support block 8 has a base 9 having a substantially rectangular configuration in plan view, and a support groove 10 is formed at the center of the base 9. Inside the support groove 10, a support frame 11 is mounted. The support frame 11 has a U-shaped cross sectional configuration with its upper end open. Further, V-shaped cutouts 12 are formed at the upper end of the support frame 11. And, as shown in FIG. 3, by the surfaces of the cutouts 12 of the support block 8, the peripheral surface of the paper feeding roller 3 is supported at two positions.

Next, the operation of this embodiment, constructed as described above, will be described.

In this embodiment, by rotating the paper feeding roller, a plurality of recording paper sheets (not shown) stacked together and accommodated are extracted one by one and conveyed to the gap between the paper feeding roller 3 and the press contact rollers 6. And, the paper feeding roller 3 is supported by the support block 8 while holding the peripheral surface of the paper feeding roller 3 being held in contact with the surfaces of the cutout portion 12 of the support block 8 at two positions and, in this condition, the paper feeding motor 4 is rotated to rotate the paper feeding roller 3, whereby the recording paper supplied from the paper supply roller is conveyed while being held between the paper feeding roller 3 and the press contact rollers 6, and conveyed to a predetermined recording position between the platen and the thermal head (not shown).

After this, the thermal head is brought into press contact with the platen through the intermediation of an ink ribbon and the recording paper, and the heat generating elements of the thermal head are selectively driven based on a desired recording signal while moving a carriage (not shown) along the platen, thereby performing a desired recording on the recording paper. And, by rotating the paper feeding roller 3 in the paper feeding direction, paper feeding associated with the line feed necessary for recording is repeated.

At this time, in this embodiment, the cutout portion 12 of the support block 8 is held in contact with the peripheral surface of the paper feeding roller 3 at two positions to support the paper feeding roller 3, so that even when the paper feeding roller 3 is elongated, it is possible to reliably prevent deflection of the paper feeding roller 3 or runout thereof during rotation. Further, since the peripheral surface of the paper feeding roller 3 is supported by the cutout portion 12 of the support block 8 only at two positions, it is possible to remarkably reduce the friction during the rotation of the paper feeding roller 3, making it possible to rotate the paper feeding roller 3 with a small driving force.

Further, in which embodiment, a plurality of support blocks 8 are arranged along the axial direction of the paper feeding roller 3, so that it is possible to prevent deflection and runout of the paper feeding roller 3 at a plurality of positions in the axial direction thereof, making it possible to support the paper feeding roller 3 in a more stable manner.

Thus, in this embodiment, by supporting the peripheral surface of the paper feeding roller 3 by the cutout portion 12 of the support block 8 at two positions, it is possible to reliably prevent deflection or runout of the paper feeding roller 3, so that even when the length dimension of the paper feeding roller 3 is rather large, it is possible to perform stable rotation of the paper feeding roller 3 with its rotation axis being fixed, with the result that it is possible to prevent feeding deviation of the recording paper, accurately convey the recording paper, and achieve an improvement in paper feeding performance.

Further, even when a large sized recording paper is conveyed, there is no need to make the diameter of the paper feeding roller 3 large, so that an increase in the production cost of the paper feeding roller 3 is not involved, making it also possible to reduce the so-called bottom margin (blank area that does not allow printing).

FIGS. 4 through 7 show another embodiment of the present invention. In this embodiment, two support rollers 14 are provided inside the support frame 11 of the support block 8 and on either side of the cutout portion 12, and the two support rollers 14 are rotatable on support shafts 13. The support rollers 14 are in rolling contact with the peripheral surface of the paper feeding roller 3 to thereby support the paper feeding roller 3.

As for the other portions, they are the same as those of the above-described embodiment, so the components which are the same as those of the above-described embodiment are indicated by the same reference numerals, and a description thereof will be omitted.

As in the above-described embodiment, in this embodiment also, the two support rollers 14 of the support block 8 are held in rolling contact with the paper feeding roller 3 to support the paper feeding roller 3, so that even when the paper feeding roller 3 is elongated, it is possible to reliably prevent deflection of the paper feeding roller 3 or runout during rotation thereof. Further, since the paper feeding roller 3 is supported by the support rollers 14 which are in rolling contact with the paper feeding roller 3, the support rollers 3 do not constitute a rotation resistor when the paper feeding roller 3 rotates, making it possible to rotate the paper feeding roller 3 with a small driving force and rotate the paper feeding roller 3 at high speed.

Thus, in this embodiment, by supporting the paper feeding roller 3 by the support rollers 14 of the support block 8, it is possible to reliably prevent deflection or runout of the paper feeding roller 3, so that even when the length dimension of the paper feeding roller 3 is large, it is possible to rotate the paper feeding roller 3 in a stable manner. As a result, it is possible to prevent feeding deviation of the recording paper, and feed the recording paper accurately, thereby achieving an improvement in paper feeding performance.

Further, even when a large recording paper is fed, there is no need to make the diameter of the paper feeding roller 3 large, so that an increase in the production cost of the paper feeding roller 3 is not involved, making it also possible to reduce the so-called bottom margin.

While in the above-described embodiment two support rollers 14 are arranged in the support frame 11 of the support block 8, the same effect can be achieved by arranging, for example, one or three or more support rollers 14.

Further, the present invention is not restricted to the above embodiments. Various modifications are possible as needed.

As described above, in the paper feeding mechanism for a printer of the present invention, the support block is held in contact with the peripheral surface of the paper feeding roller at two positions to thereby support the paper feeding roller, so that even when the paper feeding roller is elongated, it is possible to reliably prevent deflection or runout of the paper feeding roller, and even when the length dimension of the paper feeding roller is large, it is possible to rotate the paper feeding roller in a stable manner with its rotation axis being fixed. As a result, it is possible to prevent feeding deviation of the recording paper, feed the recording paper accurately, and achieve an improvement in paper feeding performance. Further, the peripheral surface of the paper feeding roller is support at only two positions by the cutout portion of the support block, so that it is possible to remarkably reduce the friction when the paper feeding roller rotates, making it possible to rotate the paper feeding roller with a small driving force.

Further, even when a large recording paper is fed, there is no need to make the diameter of the paper feeding roller large, so that an increase in the production cost of the paper feeding roller is not involved, and it is also possible reduce the so-called bottom margin.

According to the invention, the support roller of the support block is held in rolling contact with the paper feeding roller, so that even when the paper feeding roller is elongated, it is possible to reliably prevent deflection or runout of the paper feeding roller. Further, since the paper feeding roller is supported by the support roller in rolling contact with the paper feeding roller, the support roller does not constitute a rotation resistor when the paper feeding roller rotates, so that it is possible to rotate the paper feeding roller with a small driving force, and rotate the paper feeding roller at high speed.

Further, according to the present invention, the support roller of the support block is held in rolling contact with the paper feeding roller to support the paper feeding roller, so that even when the paper feeding roller is elongated, it is possible to reliably prevent deflection or runout of the paper feeding roller. Thus, even when the length dimension of the paper feeding roller is made large, it is possible to rotate the paper feeding roller in a stable manner with its rotation axis being fixed. As a result, it is possible to prevent feeding deviation of the recording paper, feed the recording paper accurately, and achieve an improvement in paper feeding performance. Further, since the support roller is in rolling contact with the paper feeding roller, the support roller does not constitute a rotation resistor when the paper feeding roller rotates, and it is possible to rotate the paper feeding roller with a small driving force, and rotate the paper feeding roller at high speed.

Further, even when a large recording paper is fed, there is no need to make the diameter of the paper feeding roller large, so that an increase in the production cost of the paper feeding roller is not involved, and it is also possible to reduce the so-called bottom margin.

Further, when a plurality of support blocks are arranged along the axial direction of the paper feeding roller, it is possible to prevent deflection of the paper feeding roller at a plurality of positions in the axial direction of the roller, making it possible, for example, to support the paper feeding roller in a more stable manner.

What is claimed is:

1. A paper feeding mechanism for a printer, comprising a paper feeding roller rotatable by a paper feeding motor, and a press contact roller held in press contact with the paper feeding roller and arranged in an axial direction of the paper feeding roller, recording paper held between the paper feeding roller and the press contact rollers, and a support block disposed on an opposite side of the press contact roller with respect to the paper feeding roller the support block being in contact at two positions with a peripheral surface of the paper feeding roller.

2. A paper feeding mechanism for a printer according to claim 1, wherein the support block comprising a support roller rotatably supported and rolling while in contact with the peripheral surface of the paper feeding roller.

3. A paper feeding mechanism for a printer, comprising a paper feeding roller rotatable by a paper feeding motor, and a press contact roller held in press contact with the paper feeding roller and arranged in an axial direction of the paper feeding roller, recording paper held between the paper feeding roller and the press contact roller, and a support block disposed on an opposite side of the press contact roller with respect to the paper feeding roller, the support block having a support roller rotatable supported and rolling while in contact with a peripheral surface of the paper feeding roller.

* * * * *